US009782024B1

(12) United States Patent
Hoger

(10) Patent No.: US 9,782,024 B1
(45) Date of Patent: Oct. 10, 2017

(54) BED COVERING SYSTEM

(71) Applicant: Sheryl Hoger, Commerce City, CO (US)

(72) Inventor: Sheryl Hoger, Commerce City, CO (US)

( * ) Notice: Subject to any disclaimer, the term of this patent is extended or adjusted under 35 U.S.C. 154(b) by 0 days.

(21) Appl. No.: 15/386,845

(22) Filed: Dec. 21, 2016

(51) Int. Cl.
*A47G 9/02* (2006.01)
*A47G 9/00* (2006.01)
*A47C 31/10* (2006.01)

(52) U.S. Cl.
CPC ..... *A47G 9/00* (2013.01); *A47C 31/105* (2013.01)

(58) Field of Classification Search
CPC ..... A47G 9/00; A47G 9/02; A47G 9/10
USPC ..... 5/482, 486, 490–491
See application file for complete search history.

(56) References Cited

U.S. PATENT DOCUMENTS

| | | | | |
|---|---|---|---|---|
| 4,317,244 | A | 3/1982 | Balfour-Richie | |
| D341,982 | S | 12/1993 | Yacenda | |
| 5,537,952 | A | 7/1996 | Devlin | |
| 6,122,783 | A * | 9/2000 | Herndon | A47G 9/02 5/413 R |
| 6,341,396 | B1 * | 1/2002 | Carapezza | A47G 9/0223 5/482 |
| 7,159,257 | B1 | 1/2007 | Struthers | |
| 7,600,279 | B1 * | 10/2009 | Cameron | A47G 9/0284 5/482 |
| 7,793,615 | B2 | 9/2010 | Rector et al. | |
| 9,282,834 | B2 | 3/2016 | Lacasse | |
| 2003/0163870 | A1 | 9/2003 | Porter et al. | |
| 2007/0107662 | A1 | 5/2007 | Queen et al. | |
| 2008/0201845 | A1 | 8/2008 | Canning | |

* cited by examiner

*Primary Examiner* — Frederick Conley

(57) ABSTRACT

A bed covering system for inhibiting a bed from being disturbed when the bed is not used for sleeping includes a bed that may be slept upon and a plurality of pillows that are each selectively positioned on the bed. A cover is selectively positioned over the bed to inhibit debris from contacting the bed. The cover includes a flap that is positioned to cover the pillows when the cover is positioned over the bed.

4 Claims, 4 Drawing Sheets

BED COVERING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to covering devices and more particularly pertains to a new covering device for inhibiting a bed from being disturbed when the bed is not used for sleeping.

BRIEF SUMMARY OF THE INVENTION

An embodiment of the disclosure meets the needs presented above by generally comprising a bed that may be slept upon and a plurality of pillows that are each selectively positioned on the bed. A cover is selectively positioned over the bed to inhibit debris from contacting the bed. The cover includes a flap that is positioned to cover the pillows when the cover is positioned over the bed.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
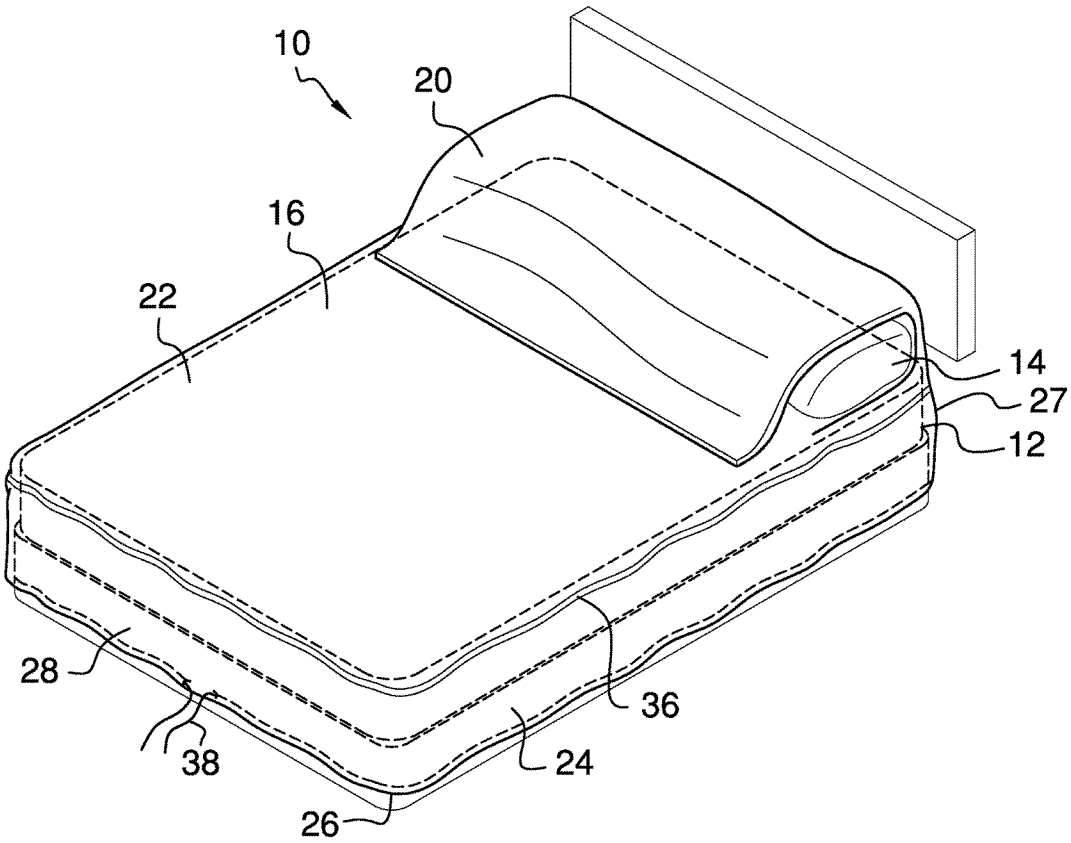
FIG. 1 is a top perspective view of a bed covering system according to an embodiment of the disclosure.
Figure 2:
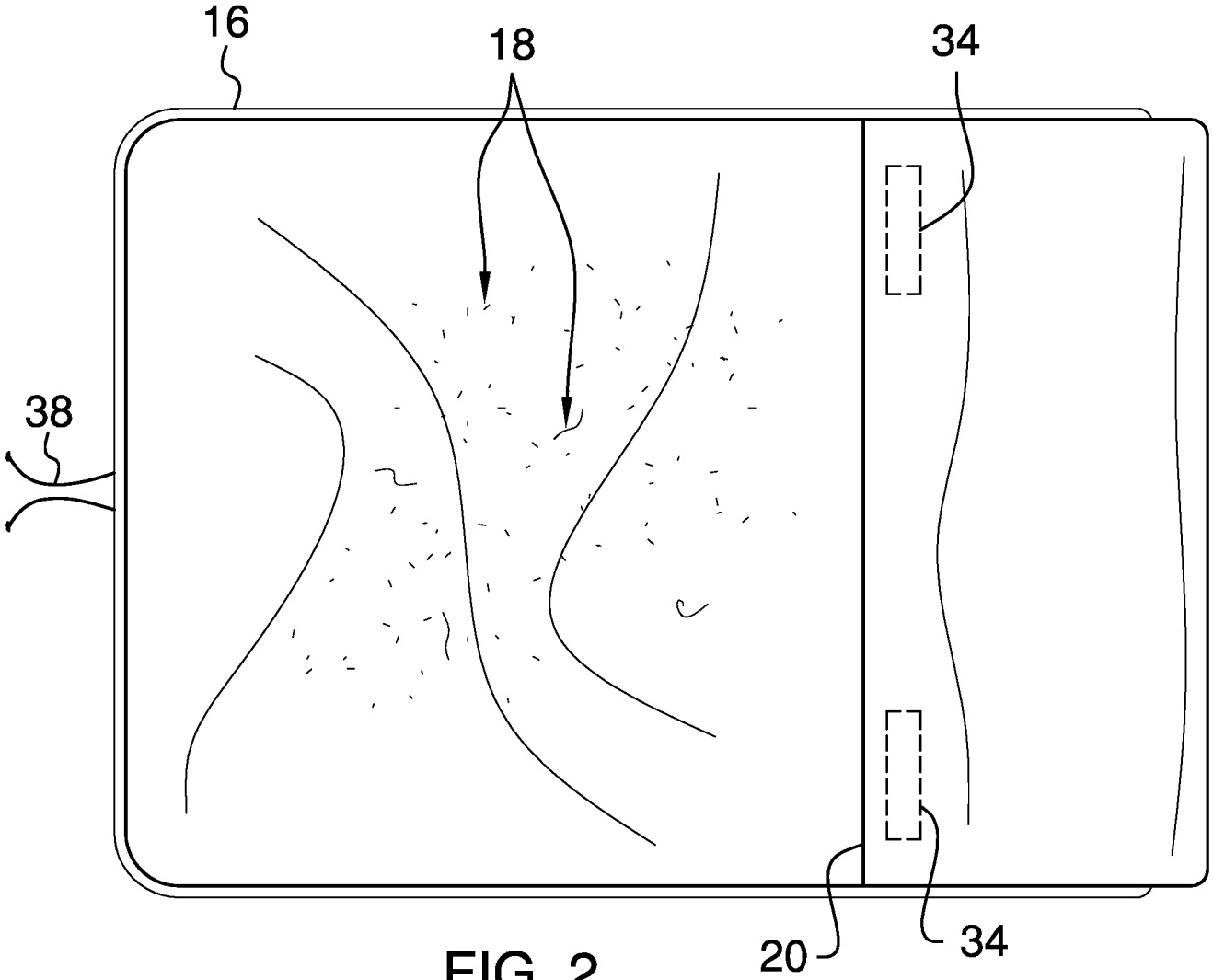
FIG. 2 is a top phantom view of an embodiment of the disclosure.
Figure 3:
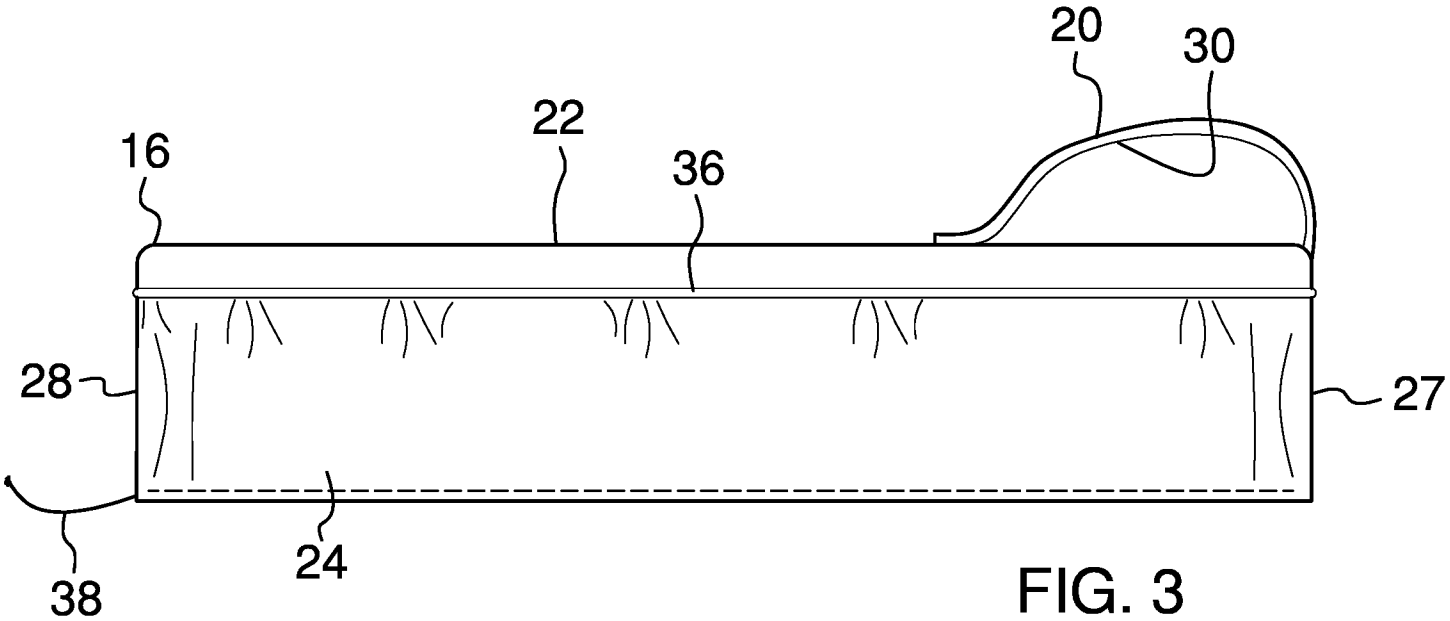
FIG. 3 is a right side view of an embodiment of the disclosure.
Figure 4:
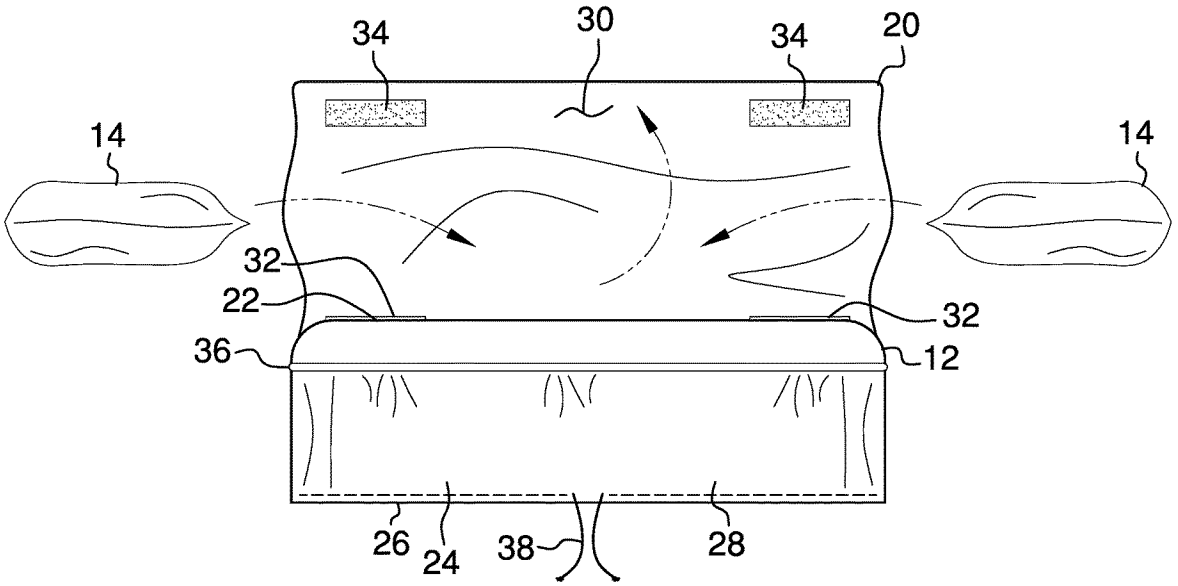
FIG. 4 is a front exploded view of an embodiment of the disclosure.

With reference now to the drawings, and in particular to FIGS. 1 through 4 thereof, a new covering device embodying the principles and concepts of an embodiment of the disclosure and generally designated by the reference numeral 10 will be described.

As best illustrated in FIGS. 1 through 4, the bed covering system 10 generally comprises a bed 12 that may be slept upon. A plurality of pillows 14 is provided and each of the pillows 14 is selectively positioned on the bed 12. The bed 12 be a king size bed, a queen size bed, a twin size bed or any other size of bed. Moreover, the bed 12 may include a mattress.

A cover 16 is provided and the cover 16 is selectively positioned over the bed 12 to inhibit debris 18 from contacting the bed 12. The debris 18 may be animal hair, dirt or any other debris 18. The cover 16 includes a flap 20 that is positioned to cover 16 the pillows 14 when the cover 16 is positioned over the bed 12. Moreover, the cover 16 inhibits the bed 12 from being disturbed 12 by children or pets. The cover 16 further inhibits odors from the pet from being transferred to the bed 12.

The cover 16 has a first wall 22 and a perimeter wall 24 extending downwardly therefrom. The perimeter wall 24 has a distal edge 26 with respect to the first wall 22 and the perimeter wall 24 has a back side 27 and a front side 28. The flap 20 is coextensively coupled to an intersection between the back side 27 and the first wall 22. The flap 20 lies on the first wall 22 and the flap 20 extends toward the front side 28. The flap 20 has a first surface 30 and the first surface 30 abuts the first wall 22. The cover 16 may be comprised of a machine washable, hypo allergenic material.

A pair of first mating members 32 is provided and each of the first mating members 32 is coupled to the first wall 22 of the cover 16. The first mating members 32 are spaced apart from each other. A pair of second mating members 34 is coupled to the first surface 30 of the flap 20. Each of the second mating members 34 selectively engages an associated one of the first mating members 32. Moreover, each of the first 32 and second 34 mating members may be complementary hook and loop fasteners or the like.

An elastic member 36 is provided and the elastic member 36 is coupled to the cover 16. The elastic member 36 is coextensive with an intersection between the first wall 22 and the perimeter wall 24. In this way the elastic member 36 biases the intersection between the first wall 22 and the perimeter wall 24 to engage the bed 12. The elastic member 36 may be an elastic member 36 of any conventional design.

A drawstring 38 is provided and the drawstring 38 is movably positioned within the cover 16. The drawstring 38 is coextensive with the distal edge 26 of the cover 16. Moreover, the drawstring 38 extends outwardly from the distal edge 26 to be selectively manipulated. The drawstring 38 urges the distal edge 26 to tighten around the bed 12 when the drawstring 38 is manipulated.

In use, the cover 16 is positioned over the bed 12 when the bed 12 is not being used for sleeping. The cover 16 is positioned such that the perimeter wall 24 of the cover 16 extends downwardly along the bed 12. The drawstring 38 is manipulated to tighten the distal edge 26 of the cover 16 around the bed 12. Each of the pillows 14 is placed on the first wall 22 of the cover 16 and the flap 20 is manipulated to cover 16 each of the pillows 14. Each of the second mating members 34 is manipulated to engage the first mating members 32 to retain the flap 20 on the pillows 14. In this way the cover 16 and the flap 20 inhibit the debris 18 from contacting the bed 12 and the pillows 14. The cover 16 is removed from the bed 12 when the bed 12 is to be used for sleeping.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A bed covering system comprising:

a bed being configured to be slept upon;

a cover being selectively positionable over said bed wherein said cover is configured to inhibit debris from contacting said bed, said cover having a first wall and a perimeter wall extending downwardly therefrom, said first wall covering an upper surface of said bed and said perimeter wall extending down around said bed when said cover is positioned on said bed, said perimeter wall having a distal edge with respect to said first wall, said perimeter wall having a back side and a front side, said cover including a flap being positioned to cover said pillows when said cover is positionable over said bed, said flap being coextensively coupled to an intersection between said back side and said first wall having said flap lying on said first wall;

a plurality of pillows being positionable on said first wall of said cover while said cover is positioned on said bed, said flap being extendable toward said front side over said pillows;

a first mating member coupled to said first wall, said first mating member being positioned in spaced relationship to said back side wherein said pillows are positionable between said first mating member and said back side; and a second mating member being positioned on said flap, said second mating member being complementary to said first mating member wherein said flap is secured extending over said pillows when said second mating member is engaged to said first mating member.

2. The system according to claim 1, further comprising an elastic member being coupled to said cover, said elastic member being coextensive with an intersection between said first wall and said perimeter wall such that said elastic member biases said intersection between said first wall and said perimeter wall to engage the bed.

3. The system according to claim 1, further comprising a drawstring being movably positioned within said cover, said drawstring being coextensive with said distal edge of said cover, said drawstring extending outwardly from said distal edge wherein said drawstring is configured to be selectively manipulated, said drawstring urging said distal edge to tighten around said bed when said drawstring is manipulated.

4. A bed covering system comprising:

a bed being configured to be slept upon;

a cover, said cover having a first wall and a perimeter wall extending downwardly therefrom, said first wall covering an upper surface of said bed and said perimeter wall extending down around said bed when said cover is positioned on said bed, said perimeter wall having a distal edge with respect to said first wall, said perimeter wall having a back side and a front side, said cover including a flap, said flap being coextensively coupled to an intersection between said back side and said first wall having said flap lying on said first wall;

a plurality of pillows being positionable on said first wall of said cover while said cover is positioned on said bed, said flap being extendable toward said front side over said pillows;

a first mating member coupled to said first wall, said first mating member being positioned in spaced relationship to said back side wherein said pillows are positionable between said first mating member and said back side;

a second mating member being positioned on said flap, said second mating member being complementary to said first mating member wherein said flap is secured extending over said pillows when said second mating member is engaged to said first mating member;

an elastic member being coupled to said cover, said elastic member being coextensive with an intersection between said first wall and said perimeter wall such that said elastic member biases said intersection between said first wall and said perimeter wall to engage the bed; and a drawstring being movably positioned within said cover, said drawstring being coextensive with said distal edge of said cover, said drawstring extending outwardly from said distal edge wherein said drawstring is configured to be selectively manipulated, said drawstring urging said distal edge to tighten around said bed when said drawstring is manipulated.

* * * * *